US008955715B2

(12) United States Patent
Kneer et al.

(10) Patent No.: US 8,955,715 B2
(45) Date of Patent: Feb. 17, 2015

(54) PACKAGING

(75) Inventors: Roland Kneer, Farchant (DE); Alexander Keller, Unterammergau (DE)

(73) Assignee: Gaplast GmbH, Altenau (DE)

( * ) Notice: Subject to any disclaimer, the term of this patent is extended or adjusted under 35 U.S.C. 154(b) by 26 days.

(21) Appl. No.: 13/577,413

(22) PCT Filed: Feb. 18, 2011

(86) PCT No.: PCT/DE2011/000146
§ 371 (c)(1),
(2), (4) Date: Aug. 6, 2012

(87) PCT Pub. No.: WO2011/103855

PCT Pub. Date: Sep. 1, 2011

(65) Prior Publication Data

US 2012/0305602 A1 Dec. 6, 2012

(30) Foreign Application Priority Data

Feb. 24, 2010 (DE) ..... 10 2010 009 102

(51) Int. Cl.
*B65D 35/28* (2006.01)
*B65D 47/20* (2006.01)
*B65D 83/00* (2006.01)

(52) U.S. Cl.
CPC ..... *B65D 47/2068* (2013.01); *B65D 83/0055* (2013.01)
USPC ..... 222/95; 222/496; 222/212; 222/94; 222/105

(58) Field of Classification Search
CPC ..... B29C 2049/227; B29B 2911/14713; B65D 47/2068
USPC ..... 222/95, 94, 105, 212, 213, 215, 496, 222/492, 494
See application file for complete search history.

(56) References Cited

U.S. PATENT DOCUMENTS 4,969,577 A 11/1990 Werding
5,529,213 A * 6/1996 Mack et al. ..... 222/95

(Continued)

FOREIGN PATENT DOCUMENTS

DE 4332885 3/1994
DE 19623030 12/1997

(Continued)

OTHER PUBLICATIONS

Machine Translation of EP 505611 A2 from European Patent Office.*

(Continued)

*Primary Examiner* — Paul R Durand
*Assistant Examiner* — Jeremy W Carroll
(74) *Attorney, Agent, or Firm* — Greer, Burns & Crain, Ltd.

(57) ABSTRACT

The packaging comprising an essentially dimensionally stable, elastically deformable external container, an easily deformable inner bag arranged therein, which receives the filling material, and a valve is characterized in that the valve comprises a base body which extends over the opening of the external container and comprises at least one through opening for the filling material and a valve holder which has fastened therein a valve body which comprises an elastically deformable partition wall tightly sealing the valve holder, and a valve pin pointing away from the external container, said partition wall together with the valve holder delimiting an air chamber under the valve pin, and comprising a cap which is fastened to the neck of the external container and covers the base body and the valve body and which delimits a receiving chamber for the filling material between the cap and the base body and comprises an outlet opening for the filling material which in the unpressurized state of the packaging is closed by the valve pin which under preload of the elastically deformable partition wall abuts on the area of the cap containing the outlet opening, the valve pin being retracted from the cap upon application of pressure to the external container by the pressurized filling material contained in the receiving chamber so that the filling material can exit, and that the cap comprises an air chamber which is separated from the receiving chamber for the filling material and sealed with respect to the receiving chamber and the external container and which is connected by means of at least one hole through the wall of the external container to the intermediate chamber between the external container and the inner bag and to the exterior atmosphere by means of at least one venting valve.

16 Claims, 3 Drawing Sheets

(56) References Cited

U.S. PATENT DOCUMENTS

| | | | | |
|---|---|---|---|---|
| 5,857,595 | A | 1/1999 | Nilson | |
| 5,862,955 | A * | 1/1999 | Albini et al. | 222/212 |
| 6,386,404 | B1 * | 5/2002 | Auer | 222/484 |
| 6,616,012 | B2 | 9/2003 | Dark | |
| 6,742,676 | B2 * | 6/2004 | Nakamura et al. | 222/95 |
| 6,953,027 | B2 * | 10/2005 | Veinotte | 123/520 |
| 7,516,874 | B2 | 4/2009 | Kneer | |
| 8,267,280 | B2 | 9/2012 | Kneer et al. | |
| 8,464,908 | B1 | 6/2013 | Tabor | |
| 8,485,398 | B2 | 7/2013 | Kneer | |
| 2003/0089735 | A1 * | 5/2003 | Iwatsubo | 222/95 |
| 2005/0224520 | A1 * | 10/2005 | Janssen et al. | 222/190 |
| 2006/0197042 | A1 | 9/2006 | Kneer | |
| 2007/0045356 | A1 | 3/2007 | Foster | |

FOREIGN PATENT DOCUMENTS

| | | | | |
|---|---|---|---|---|
| DE | 10220469 | | 11/2002 | |
| DE | 10157423 | | 6/2003 | |
| DE | 10157423 | A1 * | 6/2003 | B65D 47/28 |
| EP | 0505611 | | 9/1992 | |
| EP | 505611 | A2 * | 9/1992 | B65D 83/00 |
| FR | 2655315 | | 6/1991 | |
| GB | 2122586 | | 1/1984 | |
| GB | 2258860 | | 2/1993 | |

OTHER PUBLICATIONS

Machine Translation of DE 10157423 Al from European Patent Office.*

International Search Report, mailing date Oct. 26, 2011, issued by the European Patent Office.

* cited by examiner

PACKAGING

This application is a U.S. National Stage under 35 U.S.C. §371 of International Application No. PCT/DE2011/000146, filed Feb. 18, 2011, which claims priority from German Patent Application No. 10 2010 009 102.2, filed Feb. 24, 2010, under 35 USC §§119 and 365.

FIELD OF THE INVENTION

The present invention refers to packaging comprising an essentially dimensionally stable, elastically deformable external container, an easily deformable inner bag arranged therein, which receives the filling material, and a valve through the opening of which filling material is discharged when pressure is exerted on the external container. This is a so-called airless system in which after discharge of filling material air does not enter into the inner bag, but air enters out of the exterior atmosphere into the intermediate chamber between the external container and the inner bag, with the inner bag being more and more compressed and remaining in that state until the whole filling material has exited out of the packaging, which is also called squeeze bottle.

BACKGROUND OF THE INVENTION

Numerous types of packaging are known. For instance, DE 102 17 655 A1 discloses packaging in which the valve comprises a membrane with a sleeve-like projection which surrounds a pin of a base body extending over the opening of the external container, the filling material passing between the sleeve and the pin to the exit opening of a cap. When this packaging is used for liquid filling material, it may happen that the sleeve-like section of the membrane adheres in places to the pin of the base body upon discharge of filling material, which has the consequence that upon squeezing of the external container the liquid jet will not exit in the longitudinal direction of the external container, but in an oblique direction, so that said packaging is only suited to a limited degree for discharging liquid filling material.

SUMMARY

It is the object of the present invention to indicate packaging which is made up of few parts and which can be produced and assembled with little efforts and which is preferably also suited for liquid filling material. The packaging, however, shall not be limited thereto, but should just as well be suited for discharging pasty filling material.

This object is achieved according to the invention by a packaging comprising an essentially dimensionally stable, elastically deformable external container as described hereinbelow.

According to the invention the valve comprises a base body which extends over the opening of the external container and comprises at least one through opening for the filling material and a valve holder which is centrally positioned on the base body and has fastened therein a valve body which comprises an elastically deformable partition wall tightly closing the preferably cylindrical valve holder, and a valve pin pointing away from the valve holder, the partition wall together with the valve holder delimiting an air chamber under itself or the valve pin, respectively, and comprising a cap which is fastened to the neck of the external container and covers the base body and the valve body and the wall of which delimits a receiving chamber for the filling material between the cap and the base body and comprises a central outlet opening for the filling material which in the unpressurized state of the packaging is closed by the valve pin which under preload of the elastically deformable partition wall abuts on the area of the cap containing the outlet opening, the valve pin being retracted from the cap upon application of pressure to the external container by the pressurized filling material contained in the receiving chamber, whereby the filling material can exit. The air in the air chamber is here compressed, which in the unpressurized state of the packaging upon discharge of filing material together with the elasticity of the partition wall presses the valve pin again firmly against the cap. The valve holder is positioned radially inside the preferably plural through-openings through the base body, which openings, in turn, are provided on the edge of the opening of the external container, so that the valve holder occupies a large area on which the pressure of the filling material is acting for retracting the valve pin.

Furthermore, according to the invention the cap comprises an air chamber which is hermetically separated from the receiving chamber for the filling material and sealed with respect to the receiving chamber and the external container and which is connected by means of at least one hole through the wall of the external container to the intermediate chamber between the external container and the inner bag and to the exterior atmosphere by means of at least one venting valve. When the external container is compressed (squeezed), the venting valve is tightly closed by the raised pressure in the air chamber so that no air can exit out of the air chamber. The pressure exerted on the external container is thus fully exerted on the filling material that exits in the above-described way out of the exit opening of the valve. After termination of this process air enters due to the negative pressure, which is created in the intermediate chamber between the external container and the inner bag, through the venting valve into the air chamber and from there into the intermediate chamber between the external container and the inner bag because the venting valve opens due to the negative pressure until pressure compensation takes place.

The valve holder comprises a closed bottom wall and a surrounding, preferably circular cylindrical sidewall on which the partition wall tightly rests, wherein the air chamber positioned under the partition wall is delimited by the partition wall and the bottom wall of the valve holder spaced apart therefrom and is hermetically sealed relative to the receiving chamber for the filling material. The valve pin extends centrally from the partition wall in the direction of the upper wall of the cap and is in alignment with the outlet opening thereof.

Expediently, the partition wall is firmly mounted on the surrounding sidewall of the valve holder, e.g. by being glued thereto. The valve holder is preferably integrally formed on the base body.

According to a further suggestion of the invention the partition wall extends not in a flat way, but in an undulated or meander-like manner when viewed in cross section. This enhances the movability of the valve pin due to the pressure of the filling material in the upper receiving chamber of the cap.

Furthermore, it is provided that a guide means for the valve pin is attached to the inner wall of the cap next to the outlet opening. For this purpose e.g. webs may protrude from the inner wall of the cap, which extend over the area of movement of the valve pin, on which the valve pin abuts.

It goes without saying that the air chamber has such dimensions, i.e. such a height, that the valve pin can be retracted to an adequate degree from the outlet opening of the cap, so that the filling material can exit in unhindered fashion out of the outlet opening.

The packaging according to the invention is suited not only for the discharge of pasty or creamy filling material, but also for liquid filling material that can exit in axial direction out of the outlet opening of the cap.

The material suited for the base body with the valve holder preferably integrally formed thereon is e.g. HDPE or PP while the valve body consists for instance of TPE or LLDPE. A suitable material for the cap is PP.

The valve consists only of two separated components that can be quickly and easily mounted on the external container of the packaging. The cap is provided on its radially outer edge with a seal which engages into a surrounding groove in the shoulder of the external container. The seal can comprise two radially spaced-apart lips for each of which a surrounding groove is provided in the shoulder of the external container.

Preferably, two diametrically opposed venting valves are inserted into corresponding wall recesses of the annular air chamber of the cap, e.g. they may be glued in place.

The base body preferably rests on the edge of the container neck and is tightly pressed by a surrounding inner shoulder of the cap against the container edge. The base body, however, may also be inserted into the container neck.

The cap is preferably attached onto the container neck, the cap being locked in place with hook-like inner projections under an outer bead on the edge of the container neck. The cap, however, may also be screwed onto the container neck.

When the valve is mounted, the base body is placed in the preferred embodiment on the edge of the container neck and is e.g. centered by an annular shoulder. Subsequently, the cap is mounted and locks in place with hook-like attachments under the outer bead of the container neck. In this process the at least one sealing lip (preferably two sealing lips) of the seal fastened on the edge can also enter into the associated groove of the external container, or it is pressed onto the shoulder of the external container. The sealing lip consists e.g. of TPE.

The system can also be snapped in a preassembled state onto the filled bottle. To this end a snap-on device is arranged at the filling station.

The venting valve has a cross-sectional shape which is convex with respect to the air chamber, and extends in the manner of a circular arc preferably on two diametrically opposed sides of the cap. A longitudinally oriented, preferably central cut which passes through the wall of the venting valve and is configured such that no material has been cut away extends through the wall of the venting valve. This venting valve opens in the case of a negative pressure in the air chamber of the cap in that the cut somewhat spreads apart, and is tightly closed in the case of an overpressure in the air chamber by the valve being compressed on the cut.

BRIEF DESCRIPTION OF THE DRAWINGS

Further details of the invention become apparent from the following description of a preferred embodiment of the packaging and from the drawings, in which.

DETAILED DESCRIPTION OF PREFERRED EMBODIMENTS

Figure 1:
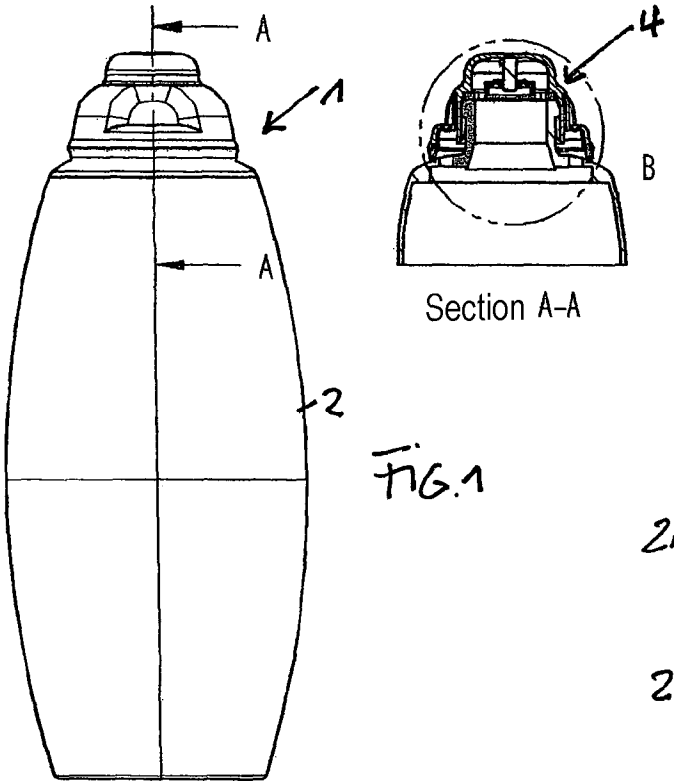
FIG. 1 is a side view of the whole packaging with a section A-A.

The whole packaging 1 is shown in FIG. 1 and contains a dimensionally stable, elastically deformable external container 2 and an inner bag 3 which receives the filling material and which in the filled initial state rests on the inner wall of the external container 2 and is firmly connected in the neck portion thereof to the external container 2. The inner bag 3 is also connected to the bottom of the external container. The neck of the external container 2 has fastened thereto a valve 4 through the outlet opening 5 of which filling material is discharged when the external container 2 is compressed. In this process the inner bag 3 contracts accordingly without ambient air entering into the inner bag for pressure compensation, so that the packaging is a so-called airless or airfree system. The external container 2 is expediently compressed laterally by a user for discharging filling material; the external container may here also be designated as a squeeze container.

Figure 2:
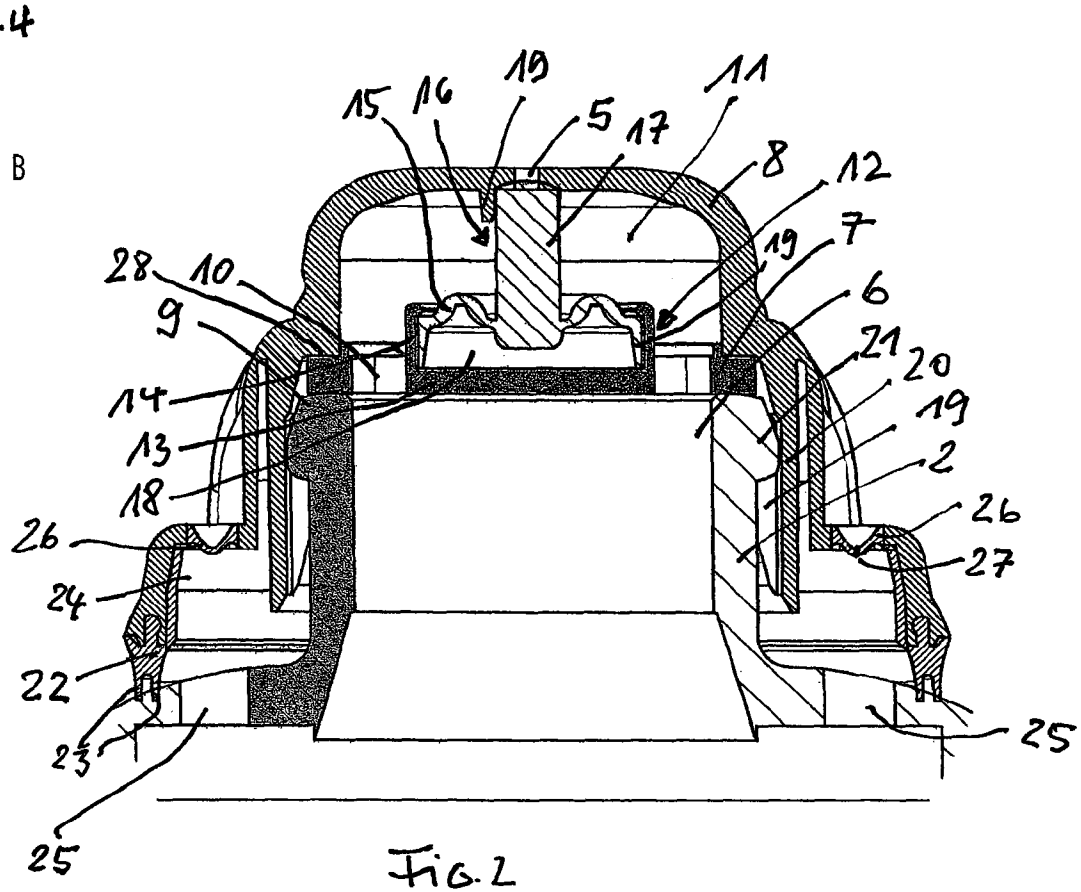
FIG. 2 is an enlarged view of area B in FIG. 1.
Figure 3:
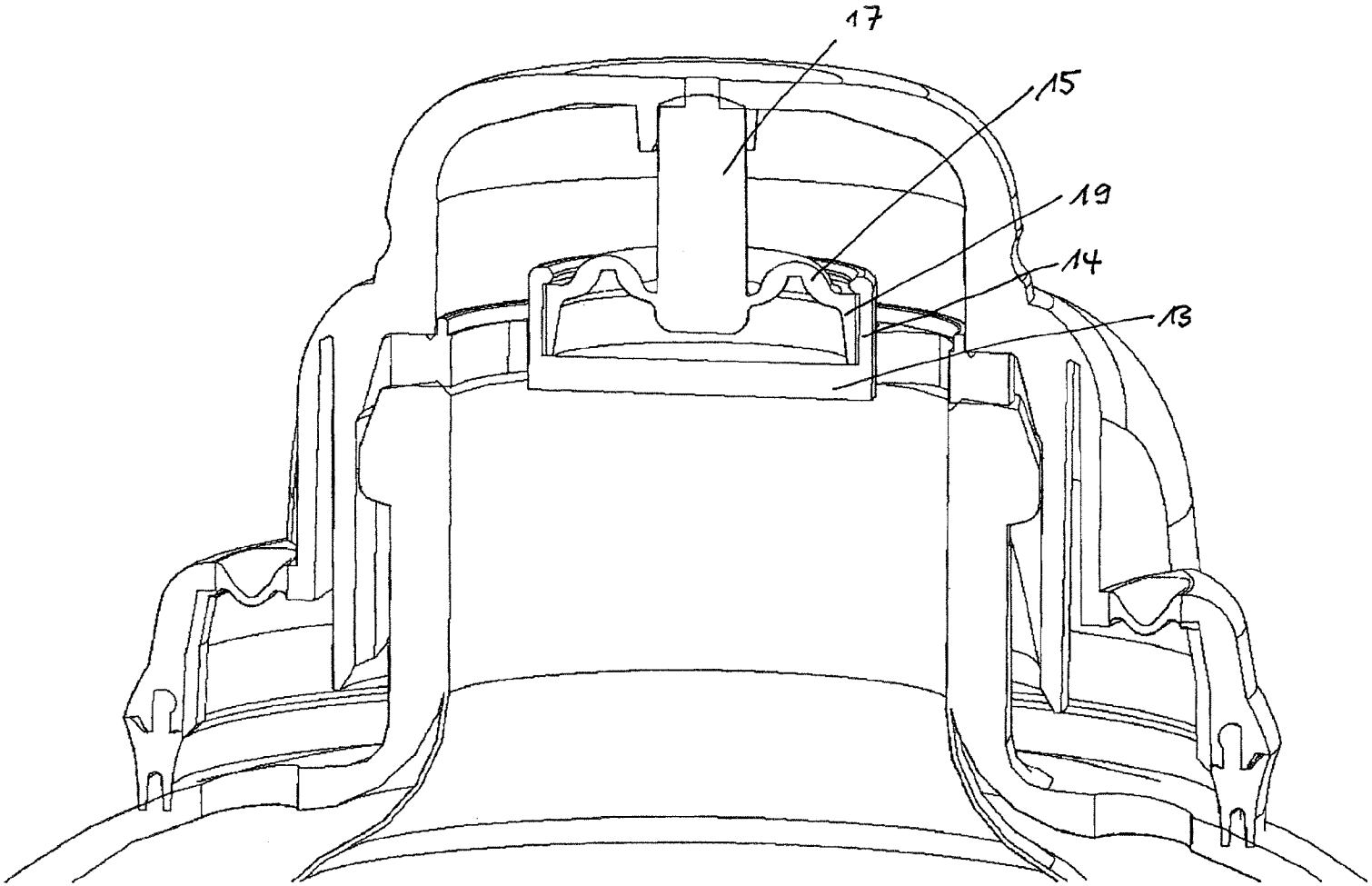
FIG. 3 is a partly cut-away perspective view of detail B in an even larger illustration.

FIGS. 2 and 3 show in more detail that the valve 4 consists essentially of a base body 7 extending transversely over the opening 6 of the external container 2 and of a cap 8 which is snapped on the outside onto the neck of the external container 2. The base body 7, which consists e.g. of HDPE, rests here with its circular edge portion on the upper edge of the container neck 9 and is firmly pressed by the cap 8 onto the container neck 9.

In the plate-shaped section extending transversely over the opening 6 of the container neck 9, the base body 7 contains a plurality of circumferentially distributed through holes 10 which connect the inner chamber of the inner bag 3 to a receiving chamber 11 for filling material which is positioned above the plate-shaped section. Furthermore, the base body 7 centrally contains a valve holder 12 which is formed by a circular or e.g. oval bottom wall 13 and a circular cylindrical or e.g. oval sidewall 14 which extends from the bottom wall 13 in the direction of the upper side of the cap 8. An undulated partition wall 15 of a valve body 16 is firmly mounted on the cylindrical circumferential wall 14 at a distance from the bottom wall 13, the valve body 16, by the way, containing a valve pin 17 which extends from the center of the partition wall 15 up to the upper end wall of the cap 8. The valve pin 17 and the partition wall 15 are integrally formed, with an air chamber 18 being tightly enclosed under the partition wall 15. The undulated partition wall 15 is provided radially on the outside with a surrounding wall section 19 which is glued on the inside to the cylindrical circumferential wall 14 of the valve holder 12.

The upper end section of the valve pin 17 is guided by two or plural webs 19 that are distributed over the circumference and attached to the upper end wall of the cap 8 when the valve pin 17 is pulled downwards by the filling material which is under pressure in the receiving chamber 11 so that filling material can exit out of the outlet opening 5, with the valve pin 17 being again pushed due to the elasticity of the partition wall 15 and the air compressed in the air chamber 18 back into the initial position shown in FIG. 2, in which the valve pin 17 tightly seals the outlet opening 5.

When mounted on the container neck 9, the cap 8 locks in place with radially inner hook-like projections 19 on axial webs 20 under the outer bead 21 on the container neck.

A seal 22 which is e.g. glued into a surrounding groove in the wall of the cap 8 and contains two radially spaced-apart sealing lips 23 that engage into annular grooves in the wall of the external container 2 is positioned on the lower edge of the cap 8 which is on the whole stepped and bell-shaped. As a result, a lower air chamber 24 in the cap 8 is sealed relative to the external container 2, apart from at least two holes 25 which pass through the wall of the external container and connect the intermediate chamber between the external container 2 and the inner bag 3 to the interior of the air chamber 24, and two diametrically opposed venting valves 26 through which in case of a negative pressure in the air chamber 24 ambient air can enter for pressure compensation into the air chamber 24, but through which in case of an overpressure in the air chamber 24, no air can escape to the exterior atmosphere.

To this end the two venting valves 26, each extending over a short circular arc, have a shape which is convex relative to the interior of the air chamber 24, i.e. forwardly bulged towards the air chamber 24, the wall of the venting valves containing a central cut 27 passing through the wall.

For discharging filling material the external container 2 is laterally compressed, whereby the inner bag is also compressed in the case of venting valves 26 that are firmly closed thereby, and filling material which fills the receiving chamber 11 is pressed against the upper side of the partition wall 15. The partition wall with its pin 17 is thereby pressed downwards, so that filling material can exit in unhindered fashion. After release of the external container (i.e. after termination of the exertion of pressure) the partition wall 15 with the valve pin 17 returns again into the sealing state. As a consequence of the reduced volume of the inner bag, a negative pressure has been created in the intermediate chamber between the external container 2 and the inner bag 3, the negative pressure causing a negative pressure in the air chamber 24, with the consequence that ambient air enters for pressure compensation into the air chamber and through the hole 25 into the intermediate chamber between the external container 2 and the inner bag 3.

Figure 4:
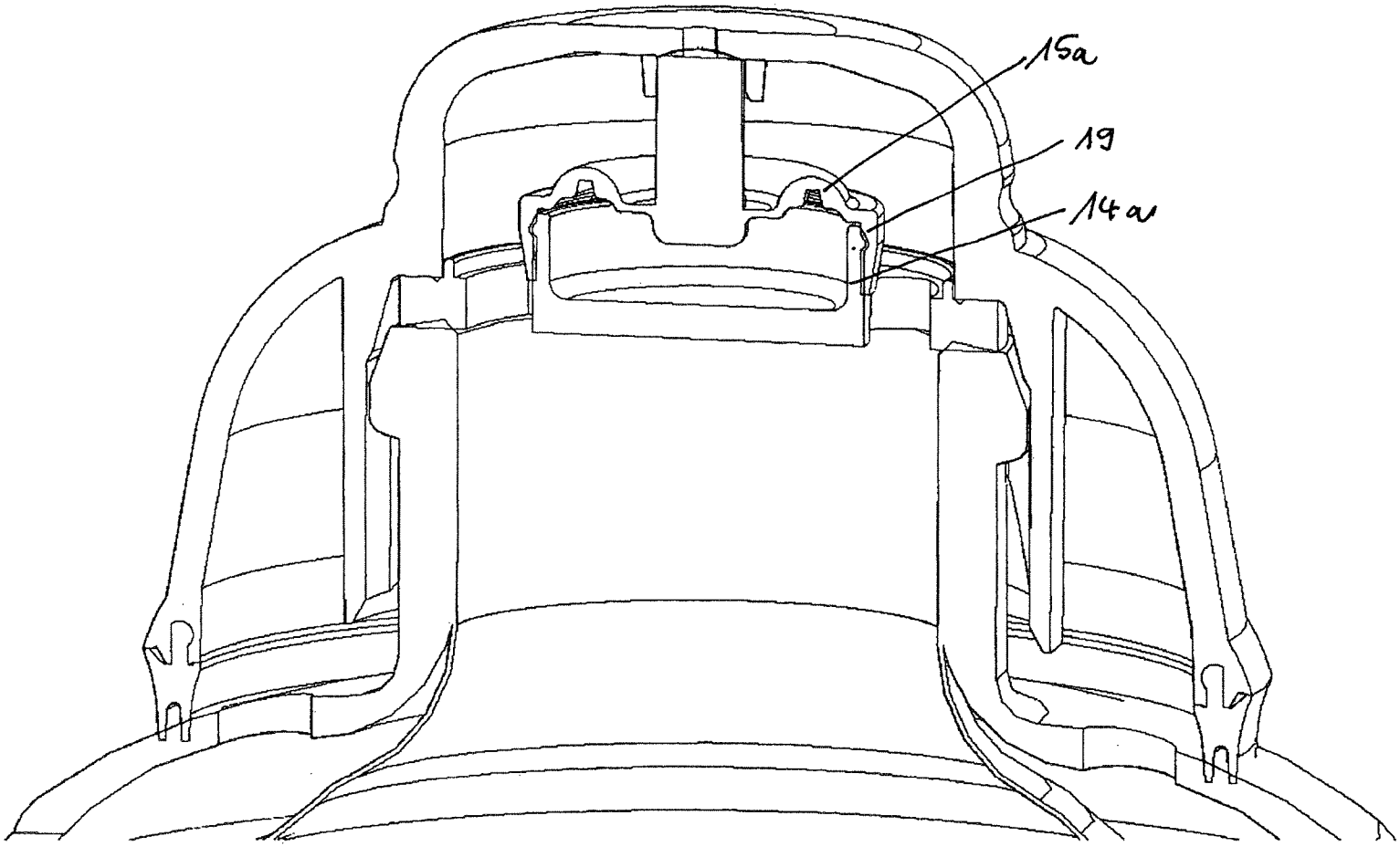
FIG. 4 is a view similar to FIG. 3 of a modified embodiment.

In the embodiment shown in FIG. 4, the surrounding wall section 19*a* of the valve body rests on the outside of the cylindrical circumferential wall 14*a* of the valve holder with an interposed olive seal.

It is emphasized that the invention is not restricted to the described and illustrated embodiments. Rather, all of the disclosed features of the embodiments can be combined with one another in any useful way also individually.

The invention claimed is:

1. Packaging comprising an external container that is substantially dimensionally stable in an initial state and that is elastically deformable, an easily deformable inner bag arranged therein, which receives the filling material, and a valve, wherein the valve comprises a base body which extends over but not into the opening of the external container and comprises at least one through opening for the filling material and a valve holder which has fastened therein a valve body which comprises an elastically deformable partition wall tightly closing the valve holder and a valve pin pointing away from the external container, the partition wall together with the valve holder delimiting a tightly enclosed air chamber under the valve pin, and comprising a cap which is fastened to the neck of the external container and covers the base body and the valve body and which delimits a receiving chamber for the filling material between the cap and the base body and has an outlet opening for the filling material which in the unpressurized state of the packaging is closed by the valve pin which under preload of the elastically deformable partition wall rests on the area of the cap containing the outlet opening to prevent ambient air from entering into the receiving chamber, the valve pin being retracted from the cap upon application of pressure to the external container by the pressurized filling material contained in the receiving chamber so that filling material can exit, and that the cap comprises an air chamber which is separated from the receiving chamber for the filling material and sealed with respect to the receiving chamber and the external container and which is connected to the intermediate chamber between the external container and the inner bag by means of at least one hole through the wall of the external container and to the exterior atmosphere by means of at least one venting valve.

2. The packaging according to claim 1, wherein the valve holder comprises a closed bottom wall and a circular cylindrical sidewall on which the partition wall tightly rests, the air chamber being delimited by the partition wall and the bottom wall which is spaced apart therefrom.

3. The packaging according to claim 2, wherein the partition wall is tightly mounted on the surrounding sidewall of the valve holder by gluing or by a snap-type connection or by an olive seal.

4. The packaging according to claim 3, wherein the partition wall extends in undulated fashion when viewed in cross section.

5. The packaging according to claim 1, wherein a guide means for the valve pin is attached to the inner wall of the cap next to the outlet opening.

6. The packaging according to claim 1, wherein the wall of the cap and of the base body delimits the receiving chamber for the filling material.

7. The packaging according to claim 1, wherein the base body rests on the edge of the container neck and is pressed by a surrounding shoulder of the cap thereagainst.

8. The packaging according to claim 1, wherein the cap is snapped in place on the external container with hook-like inner projections under an outer bead on the edge of the container neck.

9. The packaging according to claim 1, wherein the cap is provided on its outer edge with a seal which engages into a surrounding groove in a shoulder of the external container or rests with preload on the surface thereof.

10. The packaging according to claim 1, wherein the at least one venting valve is closed in case of overpressure in the air chamber and is opened in case of a negative pressure in the air chamber.

11. The packaging according to claim 10, wherein two diametrically opposed venting valves are formed.

12. The packaging according to claim 11, wherein each venting valve has a convex cross-sectional shape with respect to the air chamber, with a central cut extending in longitudinal direction and through the wall of the venting valve.

13. The packaging according to claim 10, wherein each venting valve has a convex cross-sectional shape with respect to the air chamber, with a central cut extending in longitudinal direction and through the wall of the venting valve.

14. Packaging comprising an external container that is substantially dimensionally stable in an initial state and that is elastically deformable, an easily deformable inner bag arranged therein, which receives the filling material, and a valve, wherein the valve comprises a base body which extends over the opening of the external container and comprises at least one through opening for the filling material and a valve holder which has fastened therein a valve body which comprises an elastically deformable partition wall tightly closing the valve holder and a valve pin pointing away from the external container, the partition wall together with the valve holder delimiting a tightly enclosed air chamber under the valve pin, and comprising a cap which is fastened to the neck of the external container and covers the base body and the valve body and which delimits a receiving chamber for the filling material between the cap and the base body and has an outlet opening for the filling material which in the unpressurized state of the packaging is closed by the valve pin which under preload of the elastically deformable partition wall rests on the area of the cap containing the outlet opening to prevent ambient air from entering into the receiving chamber, the valve pin being retracted from the cap upon application of pressure to the external container by the pressurized filling material contained in the receiving chamber so that filling material can exit, and that the cap comprises an air chamber which is separated from the receiving chamber for the filling material and sealed with respect to the receiving chamber and the external container and which is connected to the intermediate chamber between the external container and the inner bag by means of at least one hole through the wall of the external container and to the exterior atmosphere by means of at least one venting valve, wherein the cap is provided on its outer edge with a seal which engages into a surrounding groove in a shoulder of the external container or rests with preload on the surface thereof.

15. Packaging comprising an external container that is substantially dimensionally stable in an initial state and that is elastically deformable, an easily deformable inner bag arranged therein, which receives the filling material, and a valve, wherein the valve comprises a base body which extends over the opening of the external container and comprises at least one through opening for the filling material and a valve holder which has fastened therein a valve body which comprises an elastically deformable partition wall tightly closing the valve holder and a valve pin pointing away from the external container, the partition wall together with the valve holder delimiting a tightly enclosed air chamber under the valve pin, and comprising a unitary and substantially non-deformable cap which is fastened to the neck of the external container and covers the base body and the valve body and which delimits a receiving chamber for the filling material between the cap and the base body and has an outlet opening for the filling material which in the unpressurized state of the packaging is closed by the valve pin which under preload of the elastically deformable partition wall rests on the area of the cap containing the outlet opening to prevent ambient air from entering into the receiving chamber, the valve pin being retracted from the cap upon application of pressure to the external container by the pressurized filling material contained in the receiving chamber so that filling material can exit, and that the cap comprises an air chamber which is separated from the receiving chamber for the filling material and sealed with respect to the receiving chamber and the external container and which is connected to the intermediate chamber between the external container and the inner bag by means of at least one hole through the wall of the external container and to the exterior atmosphere by means of at least one venting valve.

16. Packaging comprising an external container that is substantially dimensionally stable in an initial state and that is elastically deformable, an easily deformable inner bag arranged therein, which receives the filling material, and a valve, wherein the valve comprises a base body which extends over but not into the opening of the external container and comprises at least one through opening for the filling material and a valve holder which has fastened therein a valve body which comprises an elastically deformable partition wall tightly closing the valve holder and a valve pin pointing away from the external container, the partition wall together with the valve holder delimiting a tightly enclosed air chamber under the valve pin, and comprising a cap which is fastened to the neck of the external container and covers the base body and the valve body and which delimits a receiving chamber for the filling material between the cap and the base body and has an outlet opening for the filling material which in the unpressurized state of the packaging is closed by the valve pin which under preload of the elastically deformable partition wall rests on the area of the cap containing the outlet opening to prevent ambient air from entering into the receiving chamber, the valve pin being retracted from the cap upon application of pressure to the external container by the pressurized filling material contained in the receiving chamber so that filling material can exit, and that the cap comprises an air chamber which is separated from the receiving chamber for the filling material and sealed with respect to the receiving chamber and the external container and which is connected to the intermediate chamber between the external container and the inner bag by means of at least one hole through the wall of the external container and to the exterior atmosphere by means of at least one venting valve, further including a plurality of webs attached to an inner wall of the cap for guiding the valve pin, the plurality of webs extending over an area of movement of the valve pin and distributed over a circumference of the outlet opening.

* * * * *